United States Patent [19]

Ladd

[11] 4,266,699

[45] May 12, 1981

[54] PLEAT FORMING MEANS AND METHOD

[76] Inventor: Harley G. F. Ladd, 34 Main South Rd., O'Halloran Hill, State of South Australia, Australia

[21] Appl. No.: 37,773

[22] Filed: May 10, 1979

[51] Int. Cl.[3] ..... A41H 43/00

[52] U.S. Cl. ..... 223/34

[58] Field of Search ..... 223/34

[56] References Cited

U.S. PATENT DOCUMENTS

| | | | |
|---|---|---|---|
| 3,084,836 | 4/1963 | Peck | 223/34 |
| 3,090,533 | 5/1963 | Claeys et al. | 223/34 X |
| 3,331,345 | 7/1967 | Firestein et al. | 223/34 X |
| 3,400,868 | 9/1968 | Euzarraga | 223/34 |
| 3,667,677 | 6/1972 | Sprong | 223/34 X |
| 4,042,155 | 8/1977 | Sprong | 223/34 |

*Primary Examiner*—Louis Rimrodt

*Attorney, Agent, or Firm*—Jay L. Chaskin

[57] ABSTRACT

A jig used to both space and form pleats. The jig has one finger which abuts a datum surface on a previously formed pleat (the datum surface being either a sew line or the loop) and another finger over which the material is folded to form a loop, so that each pleat is located from the previously formed pleat. The pleats can be sewn while retained in location by the jig, when the jig is associated with means which locate it with respect to the needle of a sewing machine.

10 Claims, 14 Drawing Figures

PLEAT FORMING MEANS AND METHOD

This invention relates to a means and method for forming pleats in material capable of being sewn.

BACKGROUND OF THE INVENTION

The formation of pleats has always constituted a time consuming operation and attempts which have been made to reduce the amount of time taken to form the series of pleats have been less than satisfactory. In some instances large and expensive machines or dividing jigs have been used, but even these have proved cumbersome and often slow to use, and there are instances where they are not used according to their optimum efficiency.

The main problem which is encountered in the formation of pleats is the difficulty of forming pleats of identical size and equally spaced in curtain fabric which can vary. Dimensional variation of any one nominal width is due to the flexible nature of fabric material. The second problem is that most prior art methods have required the separate marking and tacking of pleats before they could be sewn, and this is a time consuming operation.

BRIEF DESCRIPTION OF THE INVENTION

Briefly in this invention a jig is used to both space and form the pleats. The jig has one finger which abuts a datum surface on a previously formed pleat (the datum surface being either a sew line or the loop) and another finger over which the material is folded to form a loop, so that each pleat is located from the previously formed pleat. The pleats can be sewn while retained in location by the jig, when the jig is associated with means which locate it with respect to the needle of a sewing machine.

More specifically, in one aspect of the invention means for forming a plurality of pleats to be sewn and equally spaced across one edge of a material workpiece comprise a support having a pair of finger locating surfaces, a loop forming finger having an edge which, in use, is a loop edge; a spacing finger bifurcated by a slot defined by slot edges extending inwardly from an extended end thereof, an edge of said slot, in use, being a datum engaging surface, support engaging surfaces on the respective fingers engaging said support and locating each finger with respect to the support and also with respect to the other finger, and retaining the loop edge parallel to the datum engaging surface.

In another aspect of the invention, a method for forming pleats in a material workpiece in which the pleats are to be sewn comprises (a) determining a distance between a loop of a pleat to be formed and its pleat-forming sew line and adjusting the location of the loop forming finger of the jig described above with respect to the support thereof so that a pleat when formed over a loop edge of the loop forming finger when sewn will embody that said distance between loop and sew line, (b) determining the spacing between a datum surface of a pleat and the loop of an adjacent pleat such that said pleats (when sewn) will be equally spaced across one edge of said workpiece, and adjusting the distance between the datum engaging surface of the spacing finger and the loop edge of the loop forming finger to equal that said spacing, (c) forming a first pleat at one end of said workpiece to embody said determined distance between its loop and sew line, (d) abutting the datum engaging surface of the spacing finger against a datum surface of the already formed pleat, forming the loop of a further pleat over the loop forming finger, sewing the workpiece material so as to form said second pleat, and (e) repeating step (d) until all pleats are formed and equally spaced across the workpiece edge.

With this arrangement it is merely necessary to measure the length of the edge of the workpiece in which the pleats are to be formed, and refer that length to a chart which has been calculated (for example by a simple computer program) to give the required pleat size for the number of pleats required to be formed across the edge of the material. It is a simple matter to firstly adjust the finger of the jig which is used for determining pleat size (that is the distance between the pleat loop and the sew line) and secondly to adjust the spacing finger from the loop forming finger so as to adjust the spacing between adjacent loops, and it is found that excellent accuracy can be achieved very quickly. In most instances the support is associated with the platen of a sewing machine and if the sewing machine is of the fixed head type the fingers can be on a carriage which moves the material beneath the needle for effecting a sew line while if the machine is of the bar tack type, the material remains straight, while the sewing machine head moves over the material.

In certain domestic applications a very simple jig can be used having two fingers only and the skill or judgement of the operator can be employed to locate the sew line with respect to the loop forming finger, while in other applications a third finger may be used on a simple hand-held jig to provide marking means for pinning a pleat which is sewn after the jig is removed, but of course this very simple device is much slower and less efficient than jigs wherein the support is co-operable with the platen of the machine to locate the support and thereby retain the loop forming finger spaced from the sew line.

BRIEF DESCRIPTION OF THE DRAWINGS

Several embodiments of the invention are described hereunder in some detail with reference to and as illustrated in the accompanying drawings in which.

Figures 1, 1A:
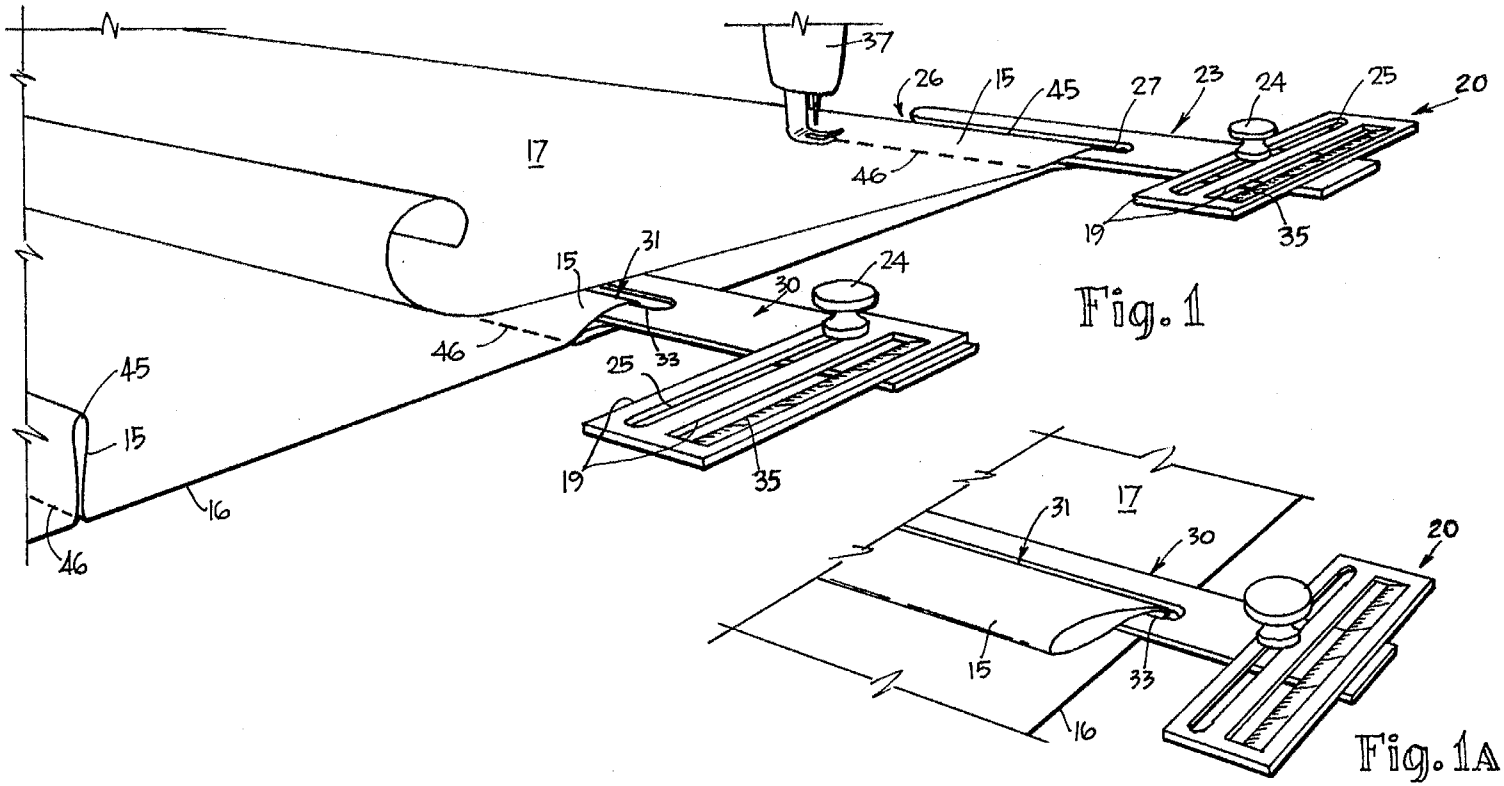
FIG. 1 is a diagrammatic perspective view showing a jig used in conjunction with a fixed head sewing machine and illustrating the manner in which the loop forming finger fixes the size of the pleat and the manner in which the spacing finger abuts a loop which forms a datum surface, being a loop of a previously formed pleat.
FIG. 1*a* shows a variation of FIG. 1 wherein the datum surface engaged by the spacing finger is the sew line of a previously formed pleat.
Figure 5:
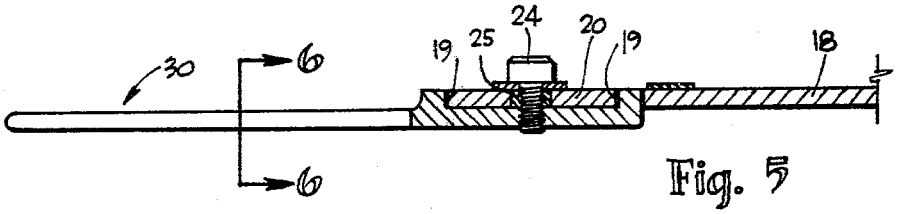
FIG. 5 is a section taken on line 5—5 of FIG. 2, but drawn to an enlarged scale.
Figure 6:
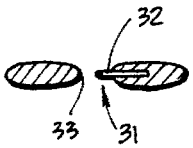
FIG. 6 is a section taken on line 6—6 of FIG. 5.
Figure 7:
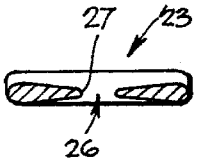
FIG. 7 is a section taken on line 7—7 of FIG. 2.

Referring first to the embodiment which is illustrated in FIGS. 1 through to 7, means for forming pleats 15 to be sewn equally spaced across one edge 16 of a workpiece 17 which is a sheet of curtain material comprises a support plate 18 which has a pair of finger guide surfaces 19 thereon, the guide surfaces as shown best in FIG. 5 being edges of measuring plates 20 which extend forwardly of the support plate 18 and are secured to it.

As seen most clearly in FIG. 1, a loop forming finger 23 is secured to the right hand side measuring plate 20 by means of a threaded nut 24 which passes through a slot 25 in the measuring plate 19, and the loop forming finger 23 is bifurcated by a slot 26 which extends inwardly from its outer end and causes the edge 27 to become a loop forming edge around which the workpiece material 17 is folded as illustrated in FIG. 1.

The other finger is a spacing finger designated 30 and is illustrated in section in FIG. 5. This is also bifurcated by a slot 31 entering through its extended end, and the slot 31 is partly closed by a spring wire 32 (or a spring loaded plate) so that if the datum engaging edge 33 of the slot 31 engages the sew line of a previously formed pleat as shown in FIG. 1*a*, the spring 32 will limit any displacement of the material and hold it from within the slot 31. The spacing finger 30 is also retained to its respective measuring plate 20 by an nut 24.

As shown best in FIG. 5, the guide surfaces 19 retain the fingers 23 and 30 parallel to one another and for movement towards or away from one another and also movement with respect to the support plate 18. Graduated scales 35 are marked on respective measuring plates 20 to provide means for determining the position of the fingers with respect to the support plate 18 and with respect to each other, the required positions being determined by reference to a chart.

Figure 2:
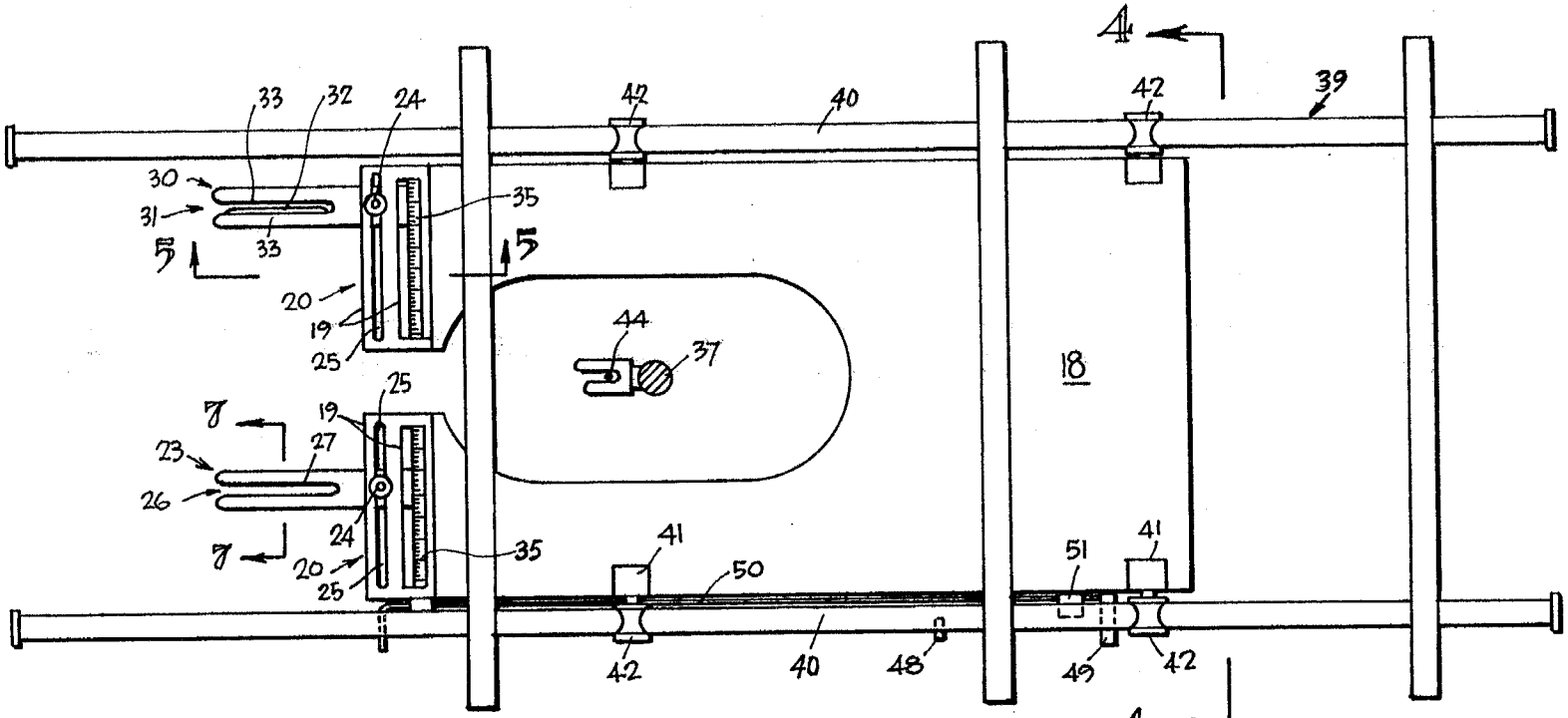
FIG. 2 is a plan view of a jig for forming pleats by the method of FIG. 1 and FIG. 1*a*, (drawn left-handed to FIG. 1)
Figure 3:
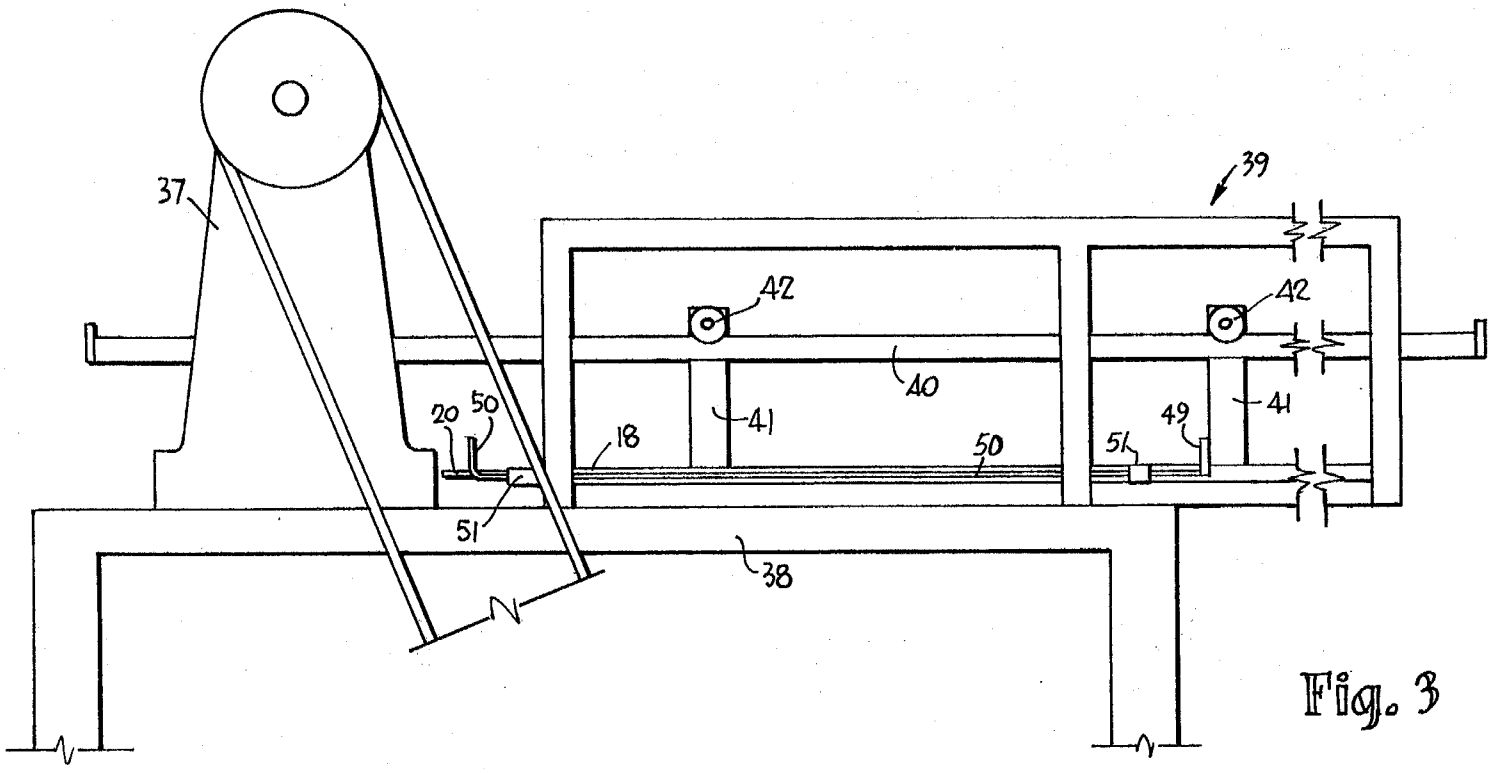
FIG. 3 is a side elevation of FIG. 2.
Figure 4:
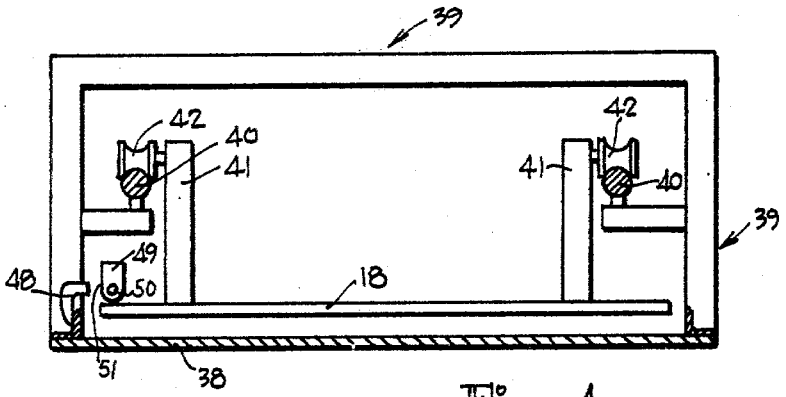
FIG. 4 is a section taken on line 4—4 of FIG. 2.

The first embodiment is referred to a sewing machine having a fixed head 37, (FIG. 2) the machine being mounted on a workbench 38, (FIG. 3) and located rearwards of the machine is a frame generally designated 39 which projects across the workbench and supports two runner guides 40, the runner guides 40 guiding for movement a carriage 41 supported by rollers 42, so that the carriage 41, together with the support plate 18 moves in a direction parallel to the datum engaging edge 33 and the loop forming edge 27 of respective fingers 30 and 23. Thus it will be seen that when the loop forming finger 23 is located at a position determined from a chart and identified by a graduated scale 35, the lateral distance between the edge 27 and the sewing needle 44 of the head 37 is fixed and thereby the space between the loop of the pleat designated 45 in FIG. 1 and the sew line 46 is also fixed.

The spacing finger 30 is also located by reference to the graduated scale 35 on its measuring plate 30 to determine the spacing between pleats. If the method of FIG. 1 is utilised, clearly the result will be different from that if the FIG. 1*a* method is utilised.

To limit movement of the carriage 41, there is provided a fixed stop 48 on the frame 39 and this is releasably engageable by a swinging arm 49 on one end of a rotatable rod 50 journalled in bearings 51 on the support plate 18.

Figure 8:
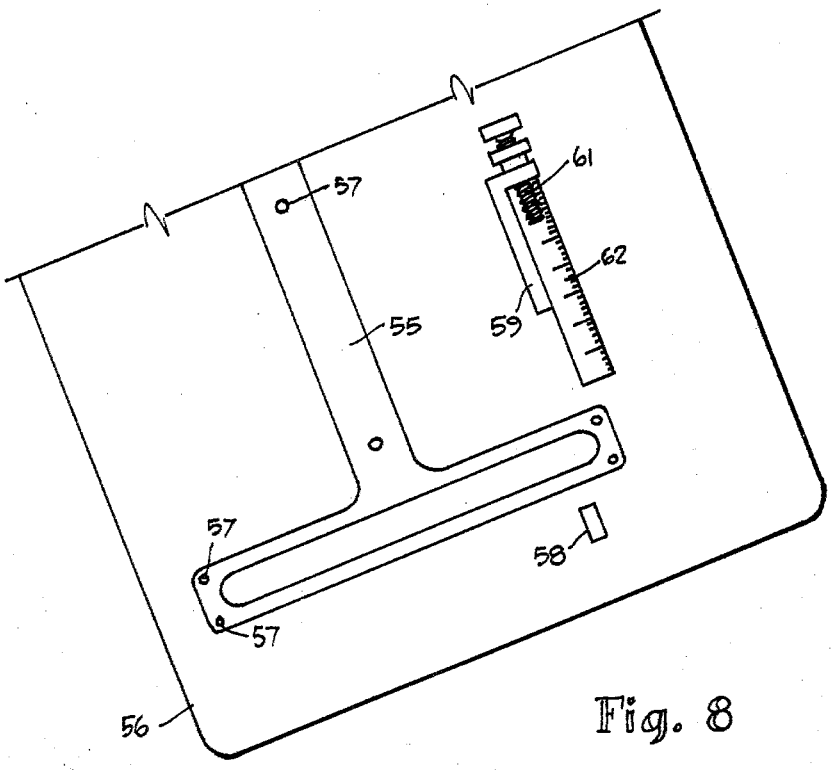
FIG. 8 is a fragmentary view of a bar tack machine showing a support plate secured to the oscillatory platen of the machine.

The embodiment is slightly varied when the invention is utilised with respect to a bar tack machine and this is illustrated in FIGS. 8 through to 11. FIG. 8 shows a oscillatory platen 55 of a bar tack machine (not otherwise illustrated) and to this is secured a supported plate 56 by fasteners 57. The support plate 56 is provided with a pair of abutment blocks 58 and 59 against which the jig 60 (FIGS. 9, 10 and 11) may be abutted. The abutment block 59 carries in it an adjustment screw 61 which is useful for locating the jig 60 with respect to the support plate 56 and thereby with respect to the sewing head of the bar tack sewing machine which is not illustrated.

Figure 9:
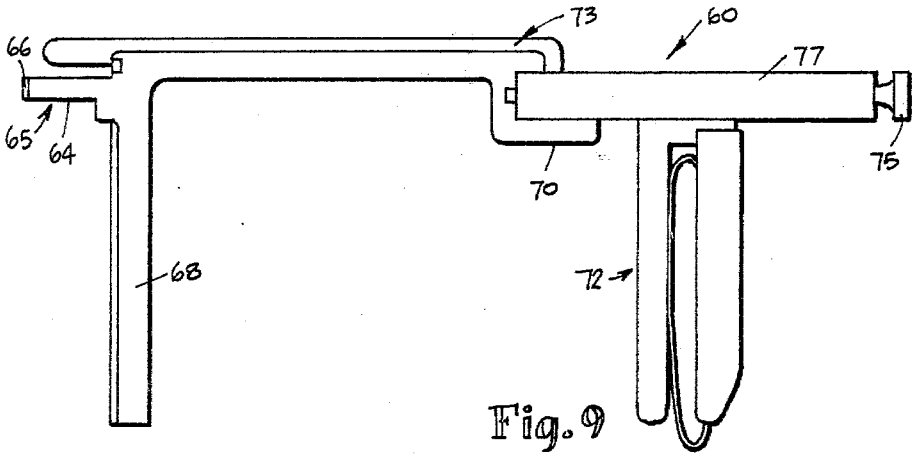
FIG. 9 is a plan view of a jig used in conjunction with the bar tack machine of FIG. 8.
Figure 10:
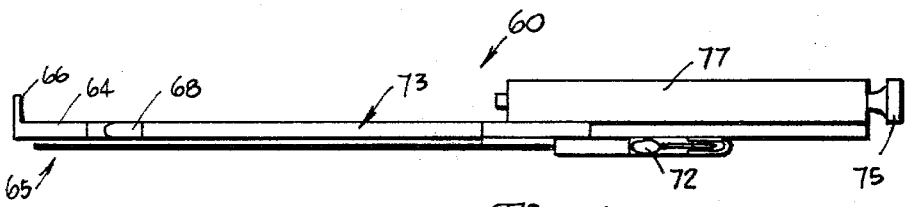
FIG. 10 is a front elevation of FIG. 9.
Figure 11:
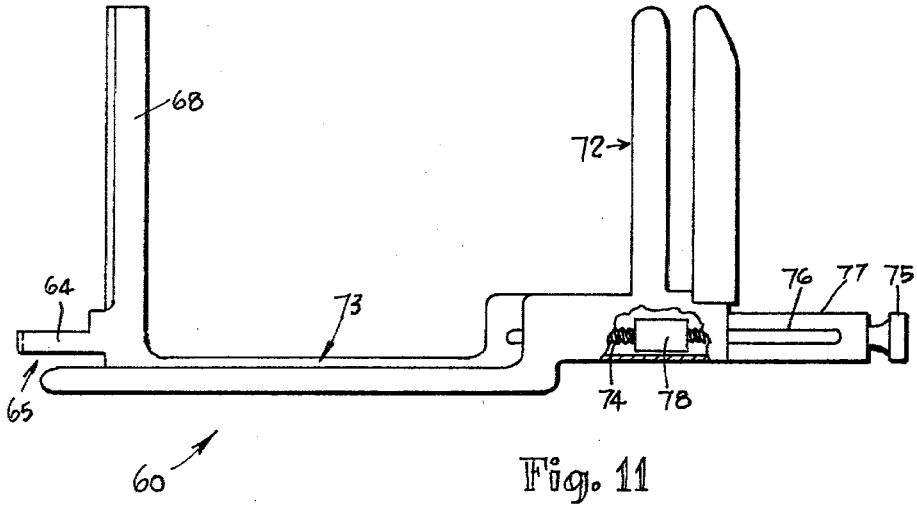
FIG. 11 is an underside view of FIG. 10.

Reference is now made to FIGS. 9, 10 and 11, wherein the jig 60 is illustrated. The jig 60 is provided with abutment surfaces, and of these the abutment surface 64 is on an extending arm 65 and arranged to abut against the side surface of block 59. When the abutment surface 64 abuts against block 59, the upstanding end 66 of arm 65 abuts the end of the adjusting screw 61 and by this means the loop forming finger 68 (which is not bifurcate) is located with respect to the sewing head and thereby the size of the pleat is fixed. A second abutment surface 70 on the jig 60 abuts block 58 to ensure that the sew lines formed are at right angles to the edge of the workpiece sheet of material.

The spacing finger 72 is positionable along the support frame 73 of the jig, being guided for movement by a screw 74 having a head 75 on one end, and a slot wall 76 in a cylinder 77 which forms portion of the frame 73. The spacing finger 72 carries on it a nut 78 illustrated only in FIG. 11, the nut being threadably engaged by the screw 74.

Figure 12:
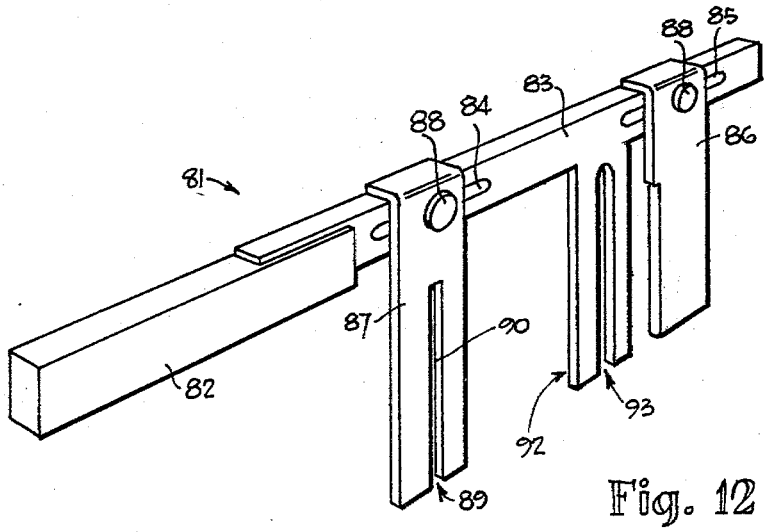
FIG. 12 is a perspective view of a simple adjustable domestic jig which, when used, employs the method of the invention.

FIG. 12 illustrates in perspective a simple "domestic" jig designated 81 which has a handle 82 on one end, and a support arm 83 extending from the handle. The arm 83 is of L-shaped section and has a pair of slots 84 and 85 therein, the slots extending longitudinally and having a common longitudinal axis. The loop forming finger 86 and a spacing finger 87 are retained to the arm 83 by screw threaded members 88 which pass through respective slots. As in the other embodiments, the spacing finger 87 is bifurcated by a slot designated 89, an edge 90 of that slot being an abutment edge for abutting the abutment surface of a previously formed pleat as in the earlier embodiments.

A third finger 92 is also provided located between the fingers 86 and 87 and being a marking finger when it is required to utilise a jig for the marking of pleats which are subsequently pinned and sewn. The finger 92 contains a slot 93 to guide the marking chalk.

Figure 13:
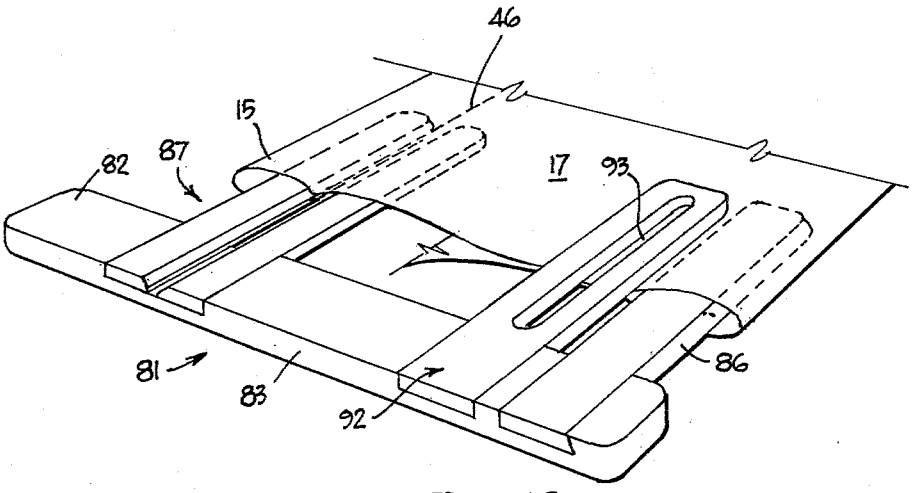
FIG. 13 is a view showing a simple domestic jig similar to FIG. 12, which however, is not adjustable.

FIG. 13 is similar to FIG. 12 and similar elements carry the same designations. The support arm 83 however, is of rectangular section, and the loop forming finger 86, the spacing finger 87 and the marking finger 92 are secured to arm 83, there being no adjustment means.

As can be seen from FIG. 13, the workpiece 17 has a first pleat 15 formed along an edge which will become the curtain edge adjacent another curtain. The next pleat is identified by folding over finger 86 and marking through slot 93, the sew line 46 of pleat 15 bearing against a slot forming edge of the bifurcate finger 87. The new pleat is also pinned, the jig 81 removed, and the pleat is sewn.

In all instances the method of forming pleats comprises firstly determining the distance between the loop of a pleat to be formed and its pleat forming sew line and so adjusting the location of the loop forming finger that it forms a loop which can be sewn (or marked and then sewn) so that the pleat will embody that distance between the loop and the sew line.

The spacing between the datum surface of the pleat and the loop of an adjacent pleat is then determined. As seen from FIG. 1 a datum surface can be a previously formed loop or a previously formed sew line. The datum distance is determined having regard to the length of the edge of the workpiece sheet along which the pleats are to be formed, the number of pleats and the length of material taken up by each pleat, so that the pleats will be equally spaced across the edge.

A first pleat is formed to the required size, and this provides a datum surface which is engageable by the spacing finger, and the second pleat is formed when the datum surface is so engaged by forming a loop of the second pleat over the loop forming finger and sewing the workpiece material, and these steps are repeated until all pleats have been formed.

Various modifications in structure and/or function may be made to the disclosed embodiments by one skilled in the art without departing from the scope of the invention as defined by the claims.

I claim:

1. Means for forming a plurality of pleats to be sewn and equally spaced across one edge of a material workpiece, said means including a jig which comprises:

a support having a pair of finger guiding surfaces;

locating means carried by a platen of a sewing machine cooperable with the support to locate the support with respect to the sewing machine needle, a loop forming finger having an edge which, in use, is a loop forming edge;

a spacing finger bifurcated by a slot defined by slot edges extending inwardly from an extended end thereof, an edge of said slot, in use, being a datum engaging surface;

guide engaging surfaces on the respective fingers engaging said support finger guiding surfaces for movement of each finger with respect to the support and also with respect to the other finger while retaining the loop forming edge parallel to the datum engaging surface;

and locking means between each of the fingers and the support operable to lock each respective finger in any one of a plurality of positions on the support.

2. Means according to claim 1 wherein said locating means comprises a frame, means securing the frame with respect to said sewing machine, runner guides on the frame, a carriage, rollers on the carriage supporting the carriage from the runner guides for movement with respect thereto, said support being a support plate on the carriage.

3. Means according to claim 1 wherein said sewing machine is a bartack machine having an oscillatory platen, and said locating means comprises a support plate secured by securing means to the oscillatory platen, and a pair of locating blocks upstanding from the support plate, said jig being not connected to the support plate but having abutment surfaces arranged to abut the locating blocks.

4. Means according to claim 1 wherein said support comprises a handle, a support arm extending from the handle, a pair of slots in the support arm extending longitudinally and having a common longitudinal axis, said fingers being retained to the support arm by screw threaded members which pass through respective said slots.

5. Means according to claim 1 further comprising a spring wire carried by said spacing finger and partly closing the slot thereof.

6. A jig forming a plurality of pleats on a fixed head sewing machine, comprising;

a frame, means securing the frame with respect to the sewing machine, runner guides on the frame, a carriage, rollers on the carriage supporting the carriage from the runner guides for movement with respect thereto, a support plate on the carriage, a pair of spaced aligned measuring plates on the front of the support plate and located one each side of the sewing machine needle, each measuring plate having an edge which is a finger guiding surface, a slot having slot walls parallel to the finger guiding surface, and a graduated scale also extending parallel to the finger guiding surface, a loop forming finger and a support finger, respective screw threaded fasteners extending through the measuring plate slots and securing said fingers to respective said measuring plates to be adjustable for position relative to the support plate and relative to each other, and surfaces on the fingers engaging said finger guiding surfaces on the respective measuring plates to retain the fingers parallel to one another and parallel to the runner guides, a slot extending inwardly from one end of the support finger bifurcating the support finger, an edge of said slot, in use, being a datum engaging surface, and an edge of the loop forming finger, in use, being a loop forming edge.

7. Means for forming a plurality of pleats on a bartack sewing machine having an oscillatory platen, comprising:

a support plate, fasteners securing the support plate to the oscillatory platen, abutment blocks secured to and upstanding from the support plate, an adjustment screw threadably engaging an abutment block, a jig having a support frame, an arm extending longitudinally from one end of the support frame, a loop forming finger extending laterally from said end of the support frame, guide surfaces on the support frame, a spacing finger extending from the guide surfaces and constrained thereby to remain in the same lateral plane as the loop forming finger, a threaded aperture at the inner end of the spacing finger, a screw constrained by the support frame for rotational movement but no translational movement with respect thereto, the screw threadably engaging said threaded aperture and being effective to move the spacing finger towards or away from the loop forming finger while retaining it parallel thereto, and a slot extending into the spacing finger from its extended end bifurcating that end, an edge of said slot, in use, being a datum engaging surface, and an edge of the loop forming finger, in use, being a loop forming edge, said support frame having abutting surfaces which, in use, abut said abutment blocks, while the end of the support frame bears against the end of the adjustment screw.

8. A method of forming pleats in a material workpiece in which pleats are to be sewn, comprising:

(a) determining a distance between a loop of a pleat to be formed and its pleat forming sew line, and adjusting the location of a loop forming finger of a jig with respect to a support on the jig so that a pleat when formed over a loop edge of that loop forming finger and sewn will embody that said distance between loop and sew line, (b) determining the spacing between a datum surface of a pleat and the loop of an adjacent pleat such that said pleats (when sewn) will be equally spaced across one edge of said workpiece, and adjusting the distance between the datum engaging surface of the spacing finger and the loop forming edge of the loop forming finger to equal that said spacing, (c) forming a pleat at one end of said workpiece to embody said determined distance between its loop and sew line, (d) abutting the datum engaging surface of the spacing finger against the datum surface of the first said pleat, forming the loop of a further pleat over the loop forming finger, sewing the workpiece material so as to form said further pleat, and (e) repeating step (d) until all pleats are formed and equally spaced across the workpiece edge.

9. The method according to claim 8 wherein said datum surface of the first said pleat is the sew line thereof, which said sew line is inserted into the slot of the spacing finger and abutted by an edge of that slot.

10. The method according to claim 8 wherein said datum surface of the first said pleat is the loop thereof, and said loop is inserted into the slot of the spacing finger and abutted by an edge of that slot.

* * * * *